US009441898B2

(12) United States Patent
Istvánovics et al.

(10) Patent No.: US 9,441,898 B2
(45) Date of Patent: Sep. 13, 2016

(54) DEVICE FOR CONVERTING A SEMI-AUTOMATIC SELF-LOADING HANDGUN TO A FULL AUTOMATIC ONE

(71) Applicants: Mihály Istvánovics, Budapest (HU); Miklós Bálint Marjai, Budapest (HU)

(72) Inventors: Mihály Istvánovics, Budapest (HU); Miklós Bálint Marjai, Budapest (HU)

(73) Assignees: GLOBSERVER STARTATÉGIA-ÉS VÉDELEMKUTÁTS FEJESZTÖ KFT, Budapest (HU); Mihály Istvánovics, Budapest (HU)

( * ) Notice: Subject to any disclaimer, the term of this patent is extended or adjusted under 35 U.S.C. 154(b) by 0 days.

(21) Appl. No.: 14/428,282

(22) PCT Filed: Sep. 11, 2013

(86) PCT No.: PCT/HU2013/000090
§ 371 (c)(1),
(2) Date: Mar. 13, 2015

(87) PCT Pub. No.: WO2014/041382
PCT Pub. Date: Mar. 20, 2014

(65) Prior Publication Data

US 2015/0241154 A1 Aug. 27, 2015

(30) Foreign Application Priority Data

Sep. 13, 2012 (HU) ..... 1200526

(51) Int. Cl.
*F41A 19/09* (2006.01)
*F41C 23/12* (2006.01)
(Continued)

(52) U.S. Cl.
CPC ..... *F41A 19/09* (2013.01); *F41A 5/02* (2013.01); *F41A 19/58* (2013.01); *F41C 23/12* (2013.01); *F41A 5/10* (2013.01); *F41A 19/33* (2013.01); *F41A 19/46* (2013.01)

(58) Field of Classification Search
CPC ..... F41A 19/09; F41A 5/02; F41A 19/33; F41A 19/58; F41A 19/46
USPC ..... 42/72, 71.01, 71.02, 73
See application file for complete search history.

(56) References Cited

U.S. PATENT DOCUMENTS 3,262,440 A * 7/1966 Kuhn ..... F41B 11/51 124/53
4,553,468 A 11/1985 Castellano et al.
(Continued)

FOREIGN PATENT DOCUMENTS

RU 2 168 141 C2 5/2001

OTHER PUBLICATIONS

International Search Report dated Mar. 6, 2014, issued in International Application PCT/HU2013/000090.
(Continued)

*Primary Examiner* — Joshua Freeman
(74) *Attorney, Agent, or Firm* — Fitch, Even, Tabin & Flannery LLP

(57) ABSTRACT

A device for converting a semi-automatic self-loading handgun into a full automatic weapon, wherein the handgun (3) comprises a slide (5) and an own trigger (11) and the handgun (3) is fixed in a front part of a case (2), in which an operating trigger (6) is arranged in a part of the case (2) behind the handgun (3), and the device comprises a means arranged between the operating trigger (6) and the own trigger (11) causing repeated and series activations of the own trigger (11) when the operating trigger (6) is in pulled state.

8 Claims, 8 Drawing Sheets

(51) Int. Cl.

| | |
|---|---|
| ***F41A 5/02*** | (2006.01) |
| ***F41A 19/58*** | (2006.01) |
| *F41A 19/33* | (2006.01) |
| *F41A 19/46* | (2006.01) |
| *F41A 5/10* | (2006.01) |

(56) References Cited

U.S. PATENT DOCUMENTS

| | | | | |
|---|---|---|---|---|
| 6,543,173 | B1 * | 4/2003 | Golan | F41A 19/09 42/75.04 |
| 7,437,847 | B1 * | 10/2008 | Mabry | F41C 23/04 42/71.02 |
| 7,552,557 | B1 * | 6/2009 | Mabry | F41A 11/04 42/71.01 |
| 2008/0121097 | A1 * | 5/2008 | Rudakevych | F41A 19/58 89/28.05 |
| 2010/0186276 | A1 | 7/2010 | Herring | |
| 2011/0088305 | A1 | 4/2011 | Oz | |
| 2012/0121829 | A1 | 5/2012 | Alvarez | |
| 2013/0185975 | A1 * | 7/2013 | Johnson | F41A 19/09 42/69.02 |
| 2015/0267992 | A1 * | 9/2015 | Alderman | F41A 19/59 42/90 |
| 2016/0018184 | A1 * | 1/2016 | Park | F41C 23/20 42/73 |
| 2016/0025438 | A1 * | 1/2016 | Alderman | F41A 17/06 42/70.11 |

OTHER PUBLICATIONS

Written Opinion issued in International Application PCT/HU2013/000090.

* cited by examiner

DEVICE FOR CONVERTING A SEMI-AUTOMATIC SELF-LOADING HANDGUN TO A FULL AUTOMATIC ONE

CROSS-REFERENCE TO RELATED APPLICATIONS

This Application is a U.S. National Stage Application filed under 35 U.S.C. §371 of International Application PCT/HU2013/000090, filed Sep. 11, 2013, designating the United States, which claims priority from Austrian Patent Application P1200526, filed Sep. 13, 2012, the complete disclosures of which are hereby incorporated herein by reference in their entirety for all purposes.

The invention relates to a device for converting a semi-automatic self-loading handgun to a full automatic weapon, in which the handgun comprises a slide and an own trigger, and the handgun is fixed and placed in a front part of a case.

State of the art handguns are generally self-loading and semi-automatic, in which by the subsequent pulling of the trigger respective shots can be launched. Owing to the displacement effect of reaction forces delivered by a shot, handguns are generally not designed as full-automatic arms, because for targeting it is required that the hand holding the arm can be used for targeting prior to the shot.

In many case the use of full-automatic arms can be justifiable, but only then if an appropriate support of the gun can be provided during the series of shots.

Even because of the justifiable nature of serial shots and of the high costs of full-automatic weapons there is an objective need of using generally available and cheap handguns for serial shooting.

For increasing the accuracy of shots and stability several designs have been known, in which the handgun is placed in a case designed to improve safe holding of the weapon.

Such a design is described in US publication 20100186276 A in which the handgun was placed in a case provided with a shoulder support at the rear part thereof and in which there is a front attachment extension of the barrel of the weapon. In these designs the shots are triggered by the own trigger of the handgun.

Several designs can be found at the internet address of www.caatactical.com at the subtitle "RONI: the PISTOL-Carbine", where the handgun is arranged in a case, in which the various designs of casings can be seen how the firm RONI could convert a pistol into a carbine.

A common characteristic of such designs is that all of them can be operated by the trigger of the handgun and neither one can be used as a full-automatic arm.

The task of the invention is to provide a device which renders the handgun built in a case to make full-automatic serial shots.

A further task is to provide a solution in which the handgun after it have been converted to launch full-automatic shots should have satisfactory holding and handling properties comparable with those of weapons designed directly for performing full-automatic shots.

The solution of the task is based on the recognition that in case of a changed function the trigger of the handgun cannot be used for triggering shots, but to this purpose a separate operating trigger should be provided at an ergonomically optimum place of the case, and this should be coupled by means of a mechanical or electromechanical unit to the own trigger of the handgun so that in the active position of the operating trigger the unit will repeatedly pull the own trigger of the handgun.

According to the invention a device has been provided for converting a semi-automatic self-loading handgun into a full automatic weapon, wherein the handgun comprises a slide and an own trigger, and the handgun is fixed in a front part of a case wherein according to the invention an operating trigger is arranged at a part of the case behind the handgun, and the device comprises a means arranged between the operating trigger and the own trigger causing repeated and series activations of the own trigger when the operating trigger is in pulled state.

In a preferable embodiment a cock is guided for linear displacement on the slide, and a direction reversing lever is arranged in front of and can be moved forward by the cock, the lever has a lower moving bar arranged directly in front of the trigger when being in initial state, and a spring is coupled to the cock that presses the cock in forward direction, and a locked connection is provided between the cock and the operating trigger when the cock is in rearmost position and the operating trigger is in initial state, and this locked connection gets released in the activated position of the operating trigger.

The operating trigger comprises preferably a central pivoting pin and at an outer end thereof a catch nest is provided that can engage a catch on the cock.

In a preferred embodiment an axial bore is provided for the spring in the cock, and the spring is arranged around a guiding bar, and the rear ends of the spring and of the guiding bar are fixed to the case.

The direction reversing lever is preferably a frame that surrounds the slide and it has upper ends interconnected by a cross bar and lower ends interconnected by the activation bar, and the frame comprises a central pivoted shaft.

The pulling will get easier if a connection is provided between the cock and the slide that moves the cock rearward when the slide is moved rearward.

An alternative embodiment comprises a current source, a micro switch operated in the activate state of the operating trigger, a motor switched on in the operated state of the micro switch and an assembly converting the rotation of the motor into a periodic reciprocating forward-backward movement, this assembly is mechanically connected to the own trigger operating it once in each period.

In this case it is preferred if a conical gear is connected to the motor and a sun gear is connected to the conical gear, and pivotally held rods are connected in an eccentric position to the sun gear, and the forward positioned rod is connected to the own trigger.

The targeting accuracy can be increased if a shoulder support is connected to the rear part of the case.

By providing a separate operating trigger in the device that is arranged substantially behind the own trigger of the handgun, the ergonomically preferred shooting position is restored i.e. the operating element will not be in a place where the weapon pressed to the shoulder is held rather than operated.

The invention will now be described in connection with preferable embodiments thereof, in which reference will be made to the accompanying drawings. In the drawing.

Figure 2:
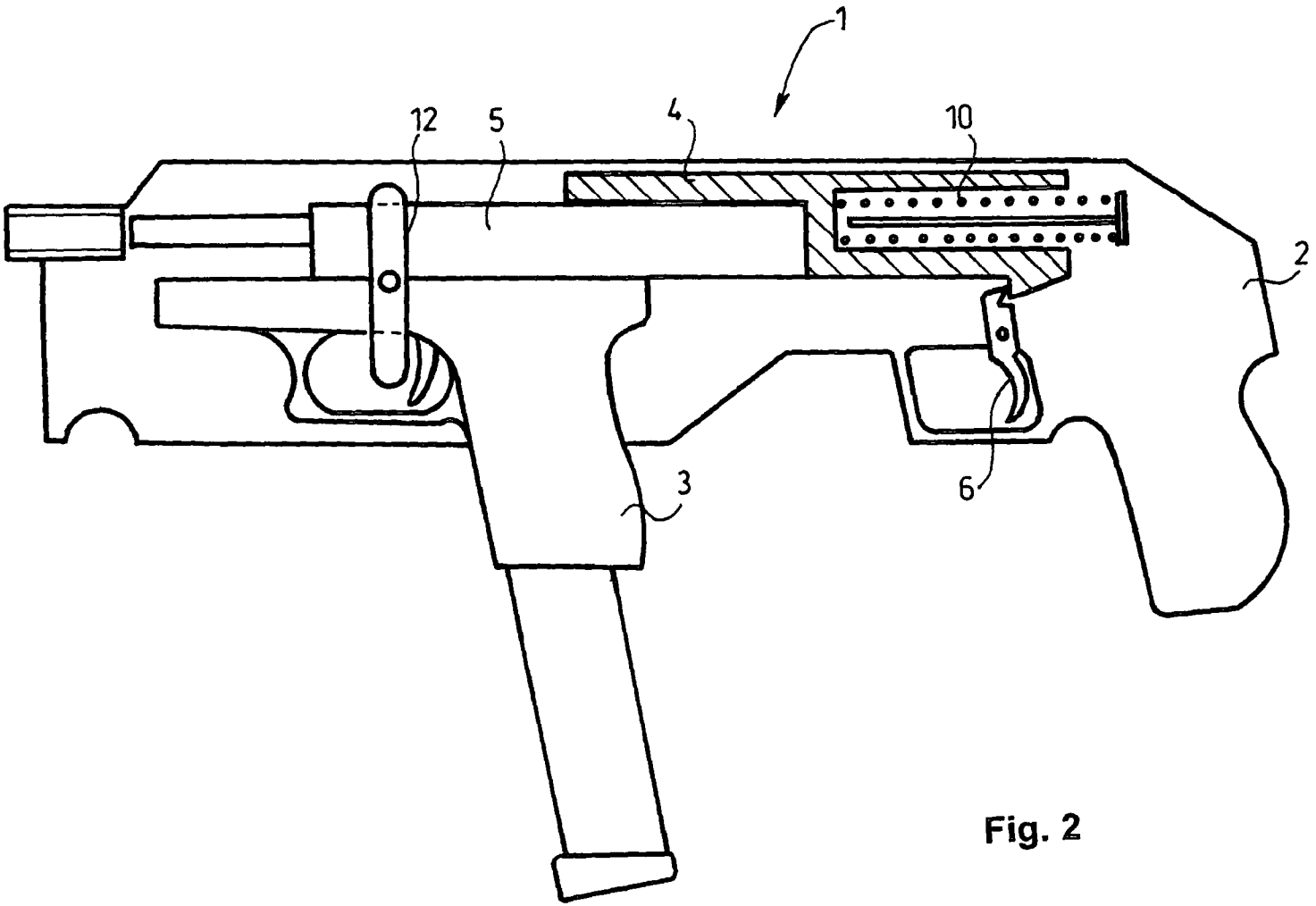
FIG. 2 is a sketch similar to that of FIG. 1, wherein the slide 5 is in its pulled rearward position.
Figure 4:
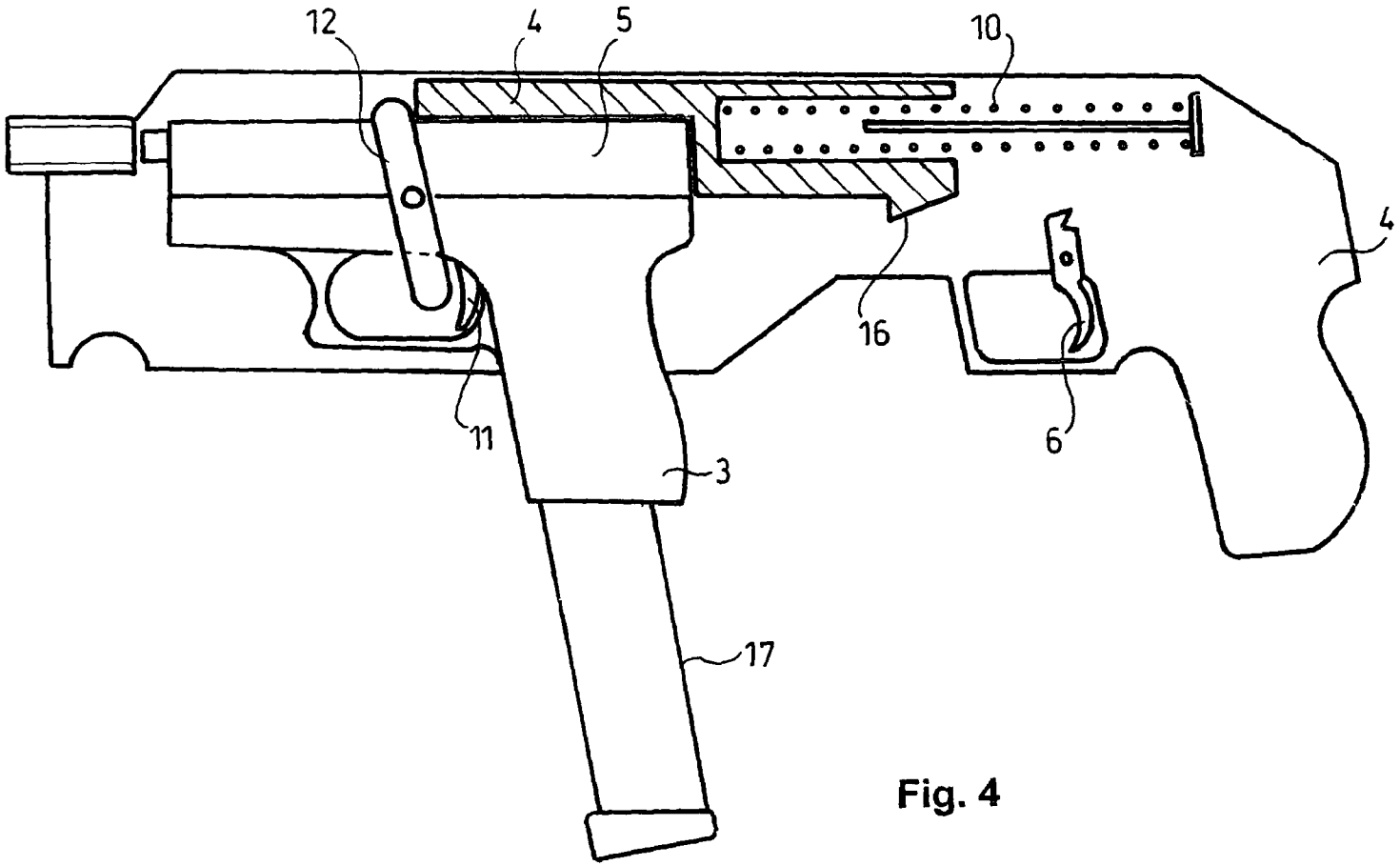
Figure 5:
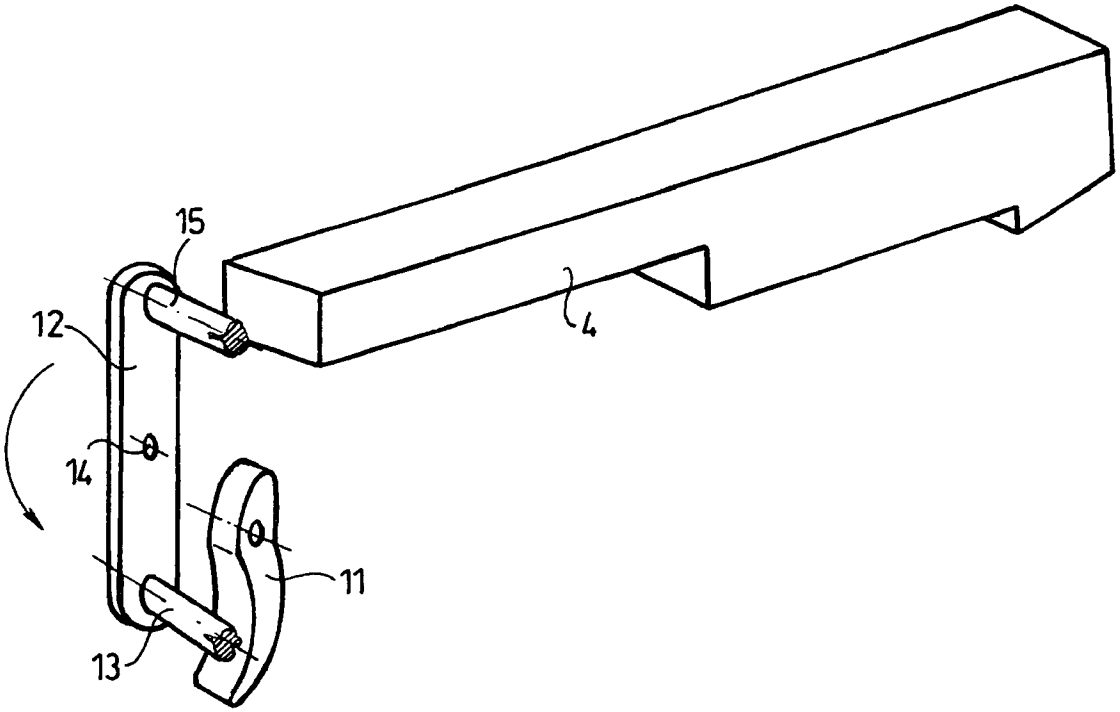
Figure 6:
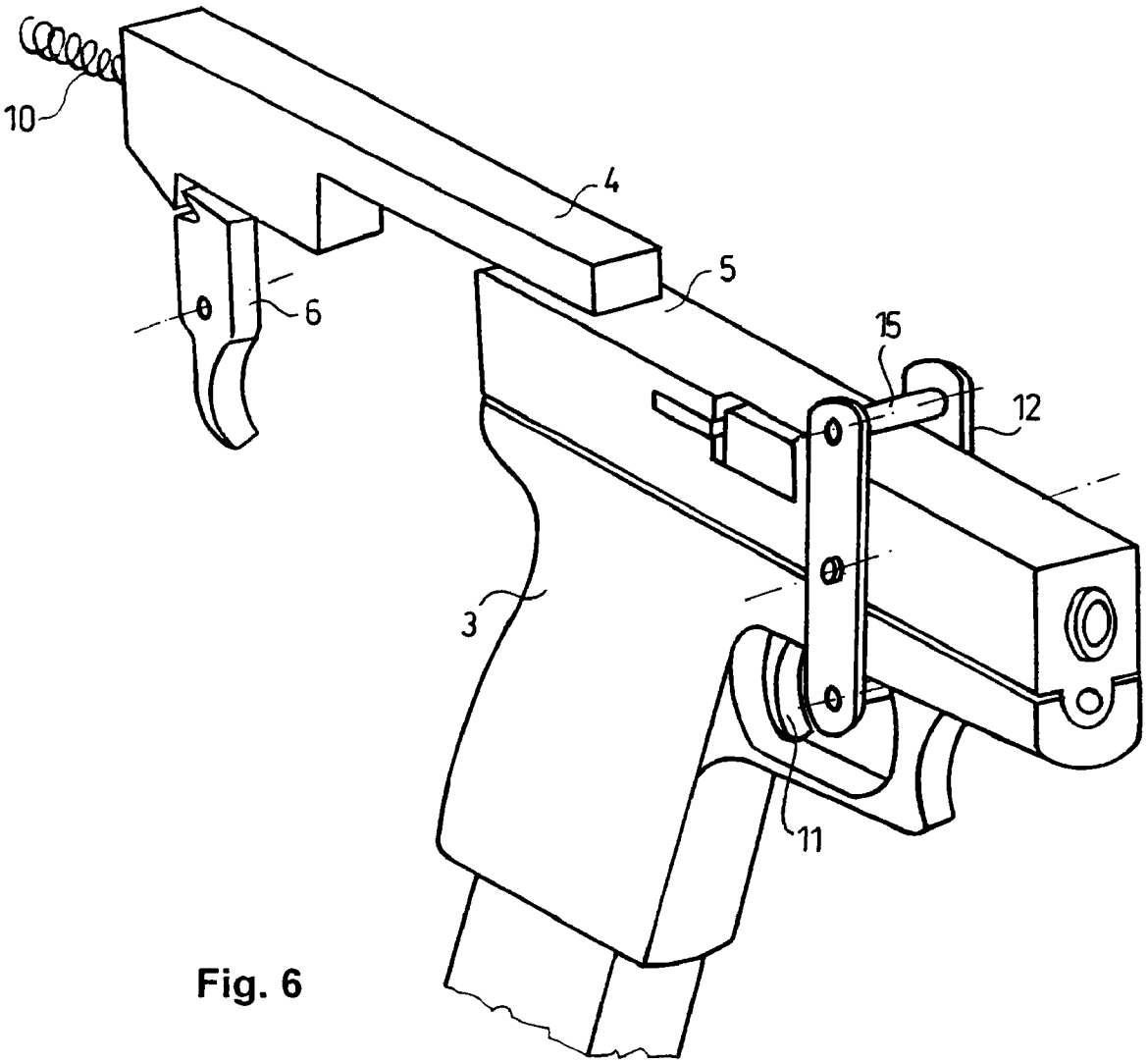
Figure 7:
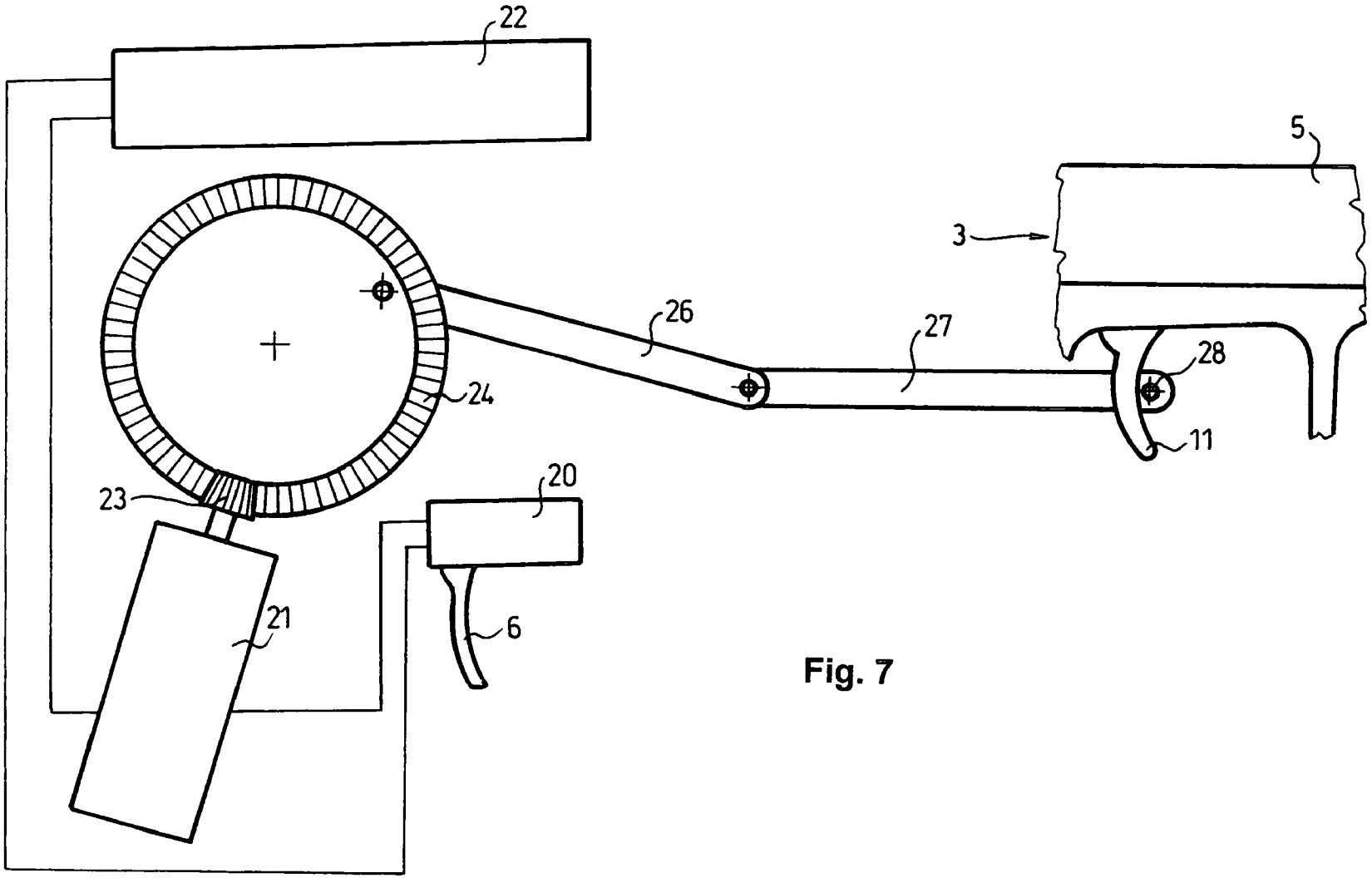

FIG. 4 a sketch similar to that of FIG. 2, wherein the bolt just presses the upper part of the direction reversing lever in forward direction;

FIG. 5 is the perspective view of a detail showing the way how the device is locked;

FIG. 6 shows a detail of the perspective view of the device;

FIG. 7 shows the schematic view of an alternative embodiment; and

Figure 8:
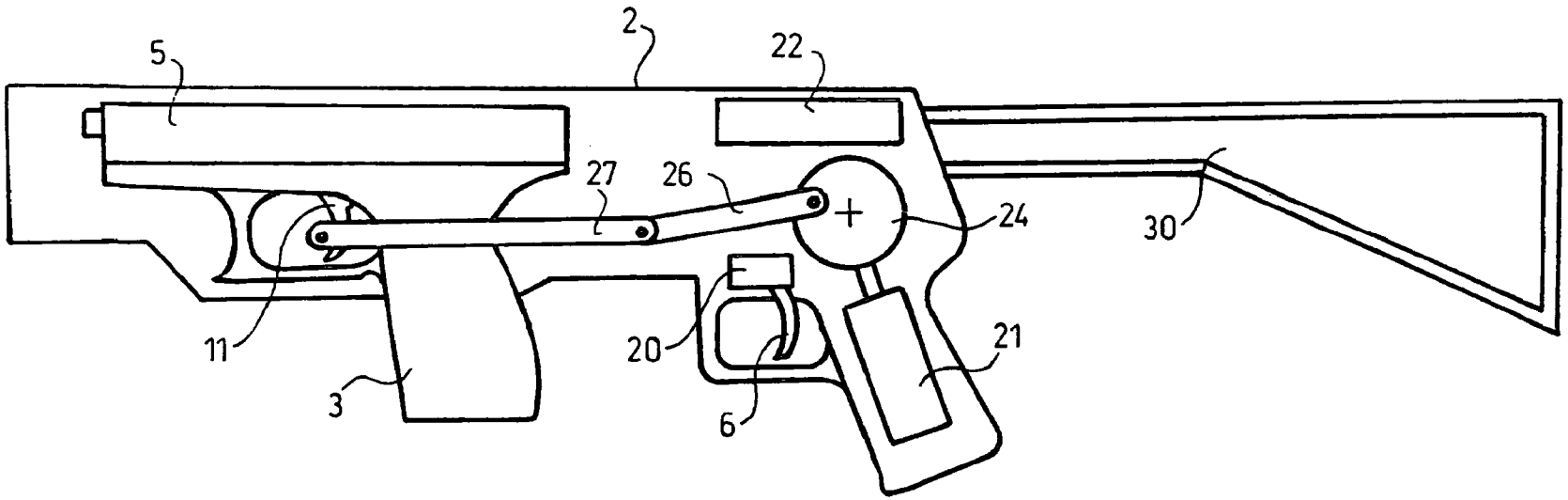

FIG. 8 shows the assembly sketch of the embodiment shown in FIG. 7.

Figure 1:
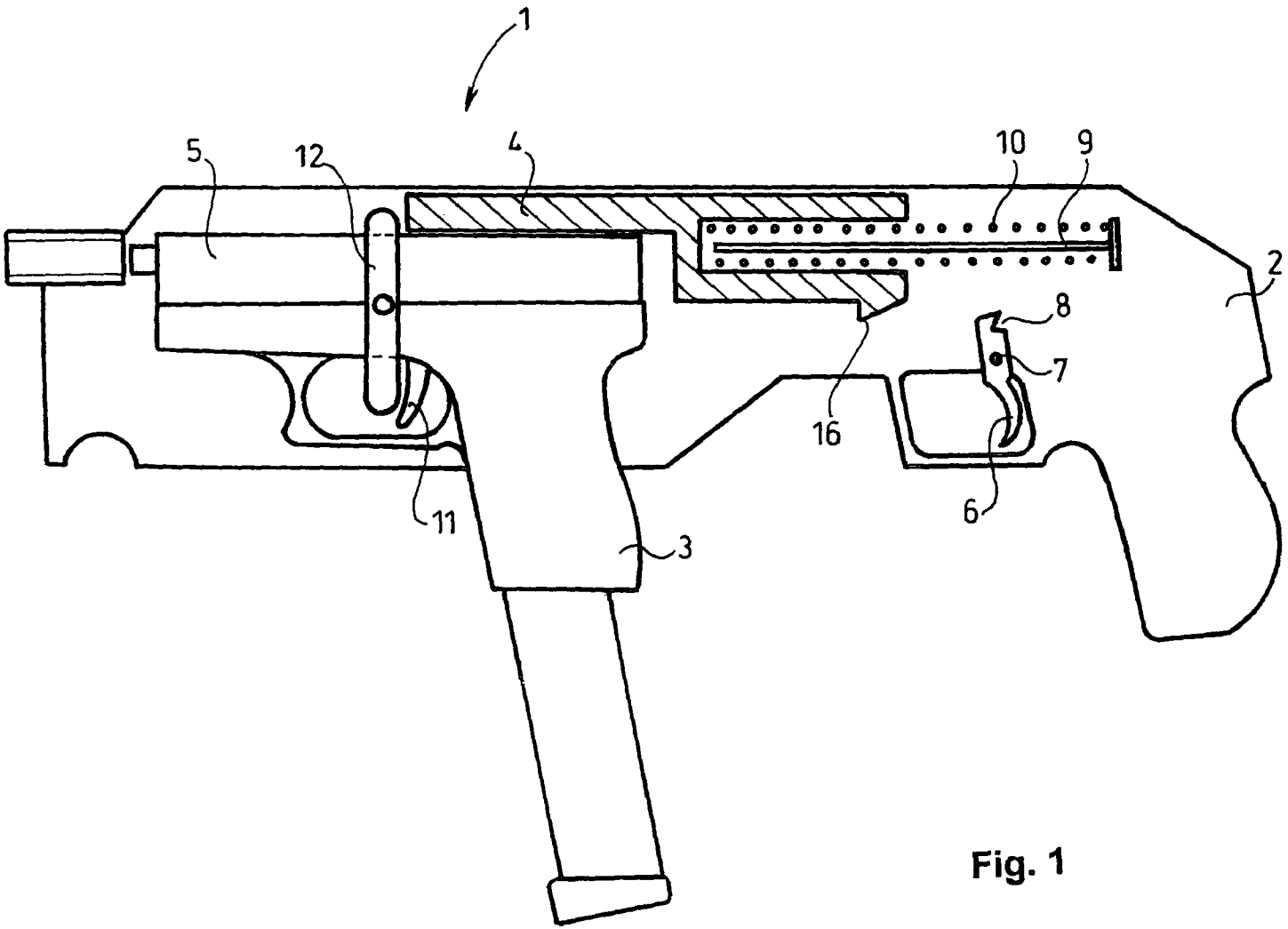
FIG. 1 shows the schematic view of the device according to the invention in starting position.

The device 1 shown in FIG. 1 consists of two parts, namely a case 2 and a handgun 3 of the semi-automatic, self-loading type which is inserted in the case 2. The case 2 is designed so that it has a front part in which the handgun 3 can be releasably fixed, and the case 2 comprises a cock 4 which is spring-biased and cooperates with and acts on slide 5 of the handgun 3. At a rear portion of the case 2 an operating trigger 6 is provided, that has a lever arm pivoted around a pin 7 and the lever has an upper end formed as a nest 8 of a catch. The rear end of the cock 4 comprises a bore in which a guiding bar 9 is fitted with a spring 10 arranged around the bar 9. The rear ends of the guiding bar 9 and of the spring 10 are resting at a rear support part of the case 2, whereby the spring 10 acts on the cock 4 to keep its position shown in FIG. 1.

The handgun 3 has an own trigger 11 which is cooperating with an actuator bar 13 of a direction-reversing lever 12 (see FIG. 5). In FIG. 5 it can be observed that the direction reversing lever 12 is pivoted around a pin inserted in a central bore 14 thereof, and the upper outer end of the lever 12 holds a cross bar 15. The cross bar 15 is arranged immediately in front of and across the forward end of the cock 4. The arms of the direction reversing lever 12 extend along the two outer side surfaces of the case 2 as a frame, and on the sectional picture of FIG. 5 only one of these arms is shown.

Figure 3:
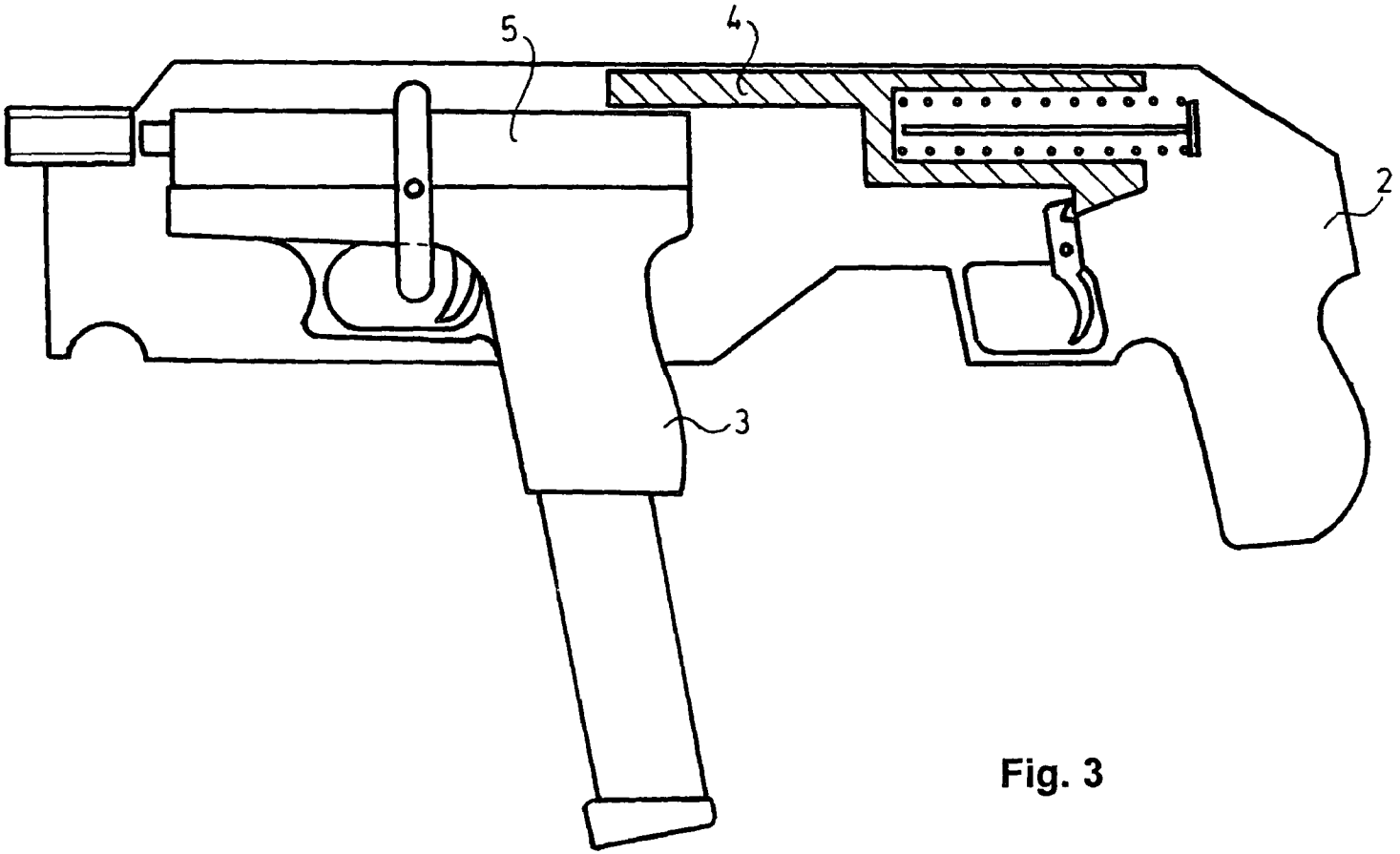
FIG. 3 is a sketch similar to that of FIG. 2, wherein the bolt of the device is in locked position and the slide is in starting or initial position.

FIG. 2 shows the device 1 when the slide 5 has been pulled in rearward direction (which is the position preceding a shot). At the lower part of the cock 4 a catch 16 is provided which engages in this position the nest 8 provided at the upper end of the operating trigger 6. In this position the spring 10 is in biased state and keeps the cock 4 in this locked state. It can also be observed in the drawing that now a distance is provided between the frontal face of the cock 4 and the direction reversing lever 12 that corresponds to the displacement of the slide 5. In FIG. 3 the difference with respect to FIG. 2 lies only in that in the handgun 3 the slide 5 has returned to its initial position shown in FIG. 1 owing to its own spring-bias, but the cock 4 has remained in the locked (biased) position shown in FIG. 2.

FIG. 4 shows the device in a position immediately after a shot when the operating trigger 6 has been pulled and the catch 16 has disengaged the nest 8, and the spring 10 has pushed the cock 4 in forward direction with a high pressing force. Under the effect of the spring force the front face of the cock 4 pushes the upper cross bar 15 of the direction reversing lever 12 forward, and as a result the lower bar 13 of the direction reversing bar 12 operates the trigger 11 by pushing it in rearward direction. The handgun 3 will then deliver a regular shot and the pushing forces of the gasses released under the effect of the shot move the slide 5 rearwards until it reaches its abutment position. Thereafter the events will depend on the position of the operating trigger 6. If we wish to deliver a series of shots, then the operating trigger 6 must be held in fully pressed position as shown in FIG. 4. In this case at the rearmost position of the slide 5 taken under the effect of the shot the catch 16 cannot engage the nest 8, and after abutment under the effect of the spring 10 a forward displacement takes place. In the meantime the direction reversing lever 12 has been moved rearward by the spring bias of the trigger 11. Then the rapidly moving front face of the cock 4 will beat again the cross bar 15 of the direction reversing lever 12 that pulls the trigger 11 delivering thereby a new shot. This process will be repeated as long as the operating trigger 6 is kept in pulled state and there is sufficient ammunition in cartridge 17 of the handgun. The frequency of the shots in the series can be adjusted by breaking the slide 5 in a per se known way. When the operating trigger 6 is released, at the next rearward motion of the cock 4 the catch 16 will engage again the nest 8 that prevents the next forward movement thereof. The operating trigger 6 enables thereby repeated single shots as well as serial shots when it is kept in pulled position.

FIGS. 5 and 6 do not contain any new structure compared to those described earlier, whereas these figures illustrate the internal design of the device, since in FIG. 5 it is clearly shown how the cock 4 activates the trigger 11 by pushing the upper cross bar 15 of the direction reversing lever 12. The perspective view of FIG. 6 shows the handgun 3 with it slide 5 and the direction reversing lever 12 encircling the profile of the slide 5. It can also be seen that the cock 4 is sitting on and is moved rearward by the movement of the slide 5 and how the cock 4 engages the operating trigger 6 by means of the catch-nest structure and how it is returned by the spring 10.

The essence of this solution lies in that in the described simple way the semi-automatic handgun 3 (pistol) can be converted into a full-automatic weapon, and the device should not be operated by the own trigger 11 of the handgun 3 anymore but by a separate operating trigger 6 forming part of the case 2. The operating trigger 6 is in a much better ergonomic position from the point of view of the comfort of the user as if he should use the trigger 11 located much further away in forward direction.

This way of operation can also be provided by the embodiment shown in FIGS. 7 and 8. FIG. 7 shows only a detail of the case 2 that includes the operating trigger 6 which is now built together with micro switch 20 that closes the circuit of a motor 21 when the operating trigger 6 is pulled. One terminal of the micro switch 20 is coupled to a current source 22, e.g. battery and the other terminal is coupled to the motor 21. The other terminal of the motor 21 is connected to the other terminal of the current source 22. On the shaft of the motor a conical gear 23 is provided that drives a sun gear 24 pivoted at its centre. A pin 25 is attached in an eccentric position to the sun gear 24 and pivotally held rods 26, 27 are coupled to the pin 25, wherein a cross bar 28 is connected to the forward end of the rod 27, which is positioned directly in front of the trigger 11 of the handgun 3 as shown in FIG. 7. If the motor 21 is switched on, it will rotate the sun gear 24 with a predetermined speed, and the rotational movement will be converted by the rods 26, 27 into a reciprocating forward-rearward movement. Once in each revolution the cross bar 28 moves in backward direction and pulls the trigger 11 that fires. As long as the operating trigger 6 is kept in pulled position, the micro switch 20 will rotate the motor 21 and once in each revolution the handgun fires a shot. A disadvantage of this embodiment is that the battery constituting the current source 22 should always be kept in charged state, i.e. one has to ensure the availability of a spare battery.

FIG. 8 shows the way how the assembly shown in FIG. 7 can be positioned in the case 2. With the illustrated sizes the illustrated parts can be easily arranged in the available space.

When the device according to the invention is used to deliver serial shots, then the back-beating effect of the shots, especially the reciprocating movement of the slide 5 exerts large mechanical effects on the device, therefore for providing accurate targeting, an appropriate support should be provided. To this end a separate shoulder support 30 can be attached to the rear part of the case 2 by which the position of the assembly can be fixed to the body in a way similar to shooting by a carbine. Similar to shooting with a carbine it can be advisable to hold the case 2 by one hand at a forward position, e.g. close to the handle of the handgun 3 and to press it to the body, while to use the other hand to operate the now properly positioned operating trigger 6 to deliver single or multiple shots. The shoulder support 30 can equally be used in the embodiment shown in FIGS. 1 to 6.

By the combined use of the case 2 and the shoulder support 30 a much more accurate weapon has been made from the handgun 3 which ensures an automatic shooting function and provides an accuracy that is comparable to shooting with a carbine, in which the operating trigger 6 has been placed into an optimum position.

The invention claimed is:

1. A device for converting a semi-automatic self-loading handgun into a full automatic weapon, wherein the handgun (3) comprises a slide (5) and an own trigger (11), and the handgun (3) is fixed in a front part of a case (2), wherein an operating trigger (6) is arranged at a part of the case (2) behind the handgun (3), and the device comprises a means arranged between the operating trigger (6) and the own trigger (11) causing repeated and series activations of the own trigger (11) when the operating trigger (6) is in pulled state, and a cock (4) is guided for linear displacement on the slide (5), and a direction reversing lever (12) is arranged in front of and can be moved forward by the cock (4), the direction reversing lever (12) has a lower moving bar (13) arranged directly in front of the trigger (11) when being in initial state and a spring (10) is coupled to the cock (4) that presses the cock (4) in forward direction, and a locked connection is provided between the cock (4) and the operating trigger (6) when the cock (4) is in rearmost position and the operating trigger (6) is in initial state, and this locked connection gets released in the activated position of the operating trigger (6).

2. The device as claimed in claim 1, wherein the operating trigger (6) comprises a central pivoting pin (7) and at an outer end thereof a catch nest (8) is provided that can engage a catch (16) on the cock (4).

3. The device as claimed in claim 1, wherein an axial bore is provided for the spring (10) in the cock (4), and the spring (10) is arranged around a guiding bar (9), and the rear ends of the spring (10) and of the guiding bar (9) are fixed to the case (2).

4. The device as claimed in claim 1, wherein the direction reversing lever (12) is a frame surrounding the slide (5) that has upper ends interconnected by a cross bar (15) and lower ends interconnected by the lower moving bar (13) and the frame comprises a central pivoted shaft.

5. The device as claimed in claim 1, wherein the device further comprises a connection s provided between the cock (4) and the slide (5) that moves the cock (4) rearward when the slide (5) is moved rearward.

6. The device as claimed in claim 1, wherein the device further comprises a current source (22), a micro switch (20) operated in the activate state of the operating trigger (6), a motor (21) switched on in the operated state of the micro switch (20) and an assembly converting the rotation of the motor (21) into a periodic reciprocating forward-backward movement, wherein the assembly is mechanically connected to the own trigger (11) operating it once in each period.

7. The device as claimed in claim 6, wherein the device further comprises a conical gear (23) is connected to the motor (21) and a sun gear (24) connected to the conical gear (23), and pivotally held rods (26, 27) connected in an eccentric position to the sun gear (24), and the forward positioned rod (27) connected to the own trigger (11).

8. The device as claimed in claim 1, wherein the device further comprises a shoulder support (30) connected to the rear part of the case (2).

* * * * *